United States Patent [19]

Jackson et al.

[11] Patent Number: 4,475,630

[45] Date of Patent: Oct. 9, 1984

[54] LIFTING DEVICE

[75] Inventors: Craig A. Jackson, Kent, Wash.; Leon R. Leadon, Portland, Oreg.

[73] Assignee: Weyerhaeuser Company, Tacoma, Wash.

[21] Appl. No.: 388,058

[22] Filed: Jun. 14, 1982

[51] Int. Cl.[3] ..... B66B 9/20

[52] U.S. Cl. ..... 187/9 R; 254/89 H

[58] Field of Search ..... 187/1 R, 8.43, 8.74, 187/8.75, 9 R; 254/89 R, 89 H, 93 R; 414/678

[56] References Cited

U.S. PATENT DOCUMENTS

| | | | |
|---|---|---|---|
| 1,410,103 | 3/1922 | Lightner et al. | 254/89 R |
| 2,576,158 | 11/1951 | Wallace | 187/8.75 |
| 3,117,652 | 1/1964 | Wallace | 187/8.75 |
| 3,680,837 | 8/1972 | Cestone et al. | 254/89 H |
| 3,752,331 | 8/1973 | Colburn | 414/678 |

FOREIGN PATENT DOCUMENTS

| | | | |
|---|---|---|---|
| 100427 | 3/1937 | Australia | 187/8.43 |

*Primary Examiner*—Joseph J. Rolla
*Assistant Examiner*—Kenneth Noland

[57] ABSTRACT

The invention is a lifting or elevator device to lift one end of a package or load for insertion of a pull-tab slip-sheet thereunder. It comprises a tiltable elevator having a load supporting cross bar raised and lowered by jacks located at each end. The jacks are rigidly mounted to each other. Both are mounted to a base member so that they can be tilted forward to move the cross bar beneath the pull tab and out of interfering position with a load handling push/pull lift truck.

10 Claims, 8 Drawing Figures

LIFTING DEVICE

BACKGROUND OF THE INVENTION

The present invention is a lifting or elevator device adapted to lift one end of a unit package so that a slip sheet can be placed thereunder. After such placement, the unit package is dropped and the elevator tilts out of the way so that the unit can be handled by a push/pull lift truck.

Push/pull lift trucks are widely used throughout industry since they do not require their loads to be on pallets, instead, the load is placed on a pull or slip sheet with a pull tab, typically 10–15 cm long, left protruding from one or more edges of the load. A push/pull lift truck is a modification of a conventional fork lift. The forks are much wider, and may be approximately equal to the full width of the loads being handled. They are also thinner at the tips to simplify insertion under the pull tab. The principal difference is the addition of a clamp unit for grasping the pull tab of the slip sheet and a ram for ejecting the load when it has reached its ultimate destination. The pull tab clamping mechanism is mounted at the bottom edge of the ram, immediately above the broad forks. In use, the truck operator will approach a load and slip the leading edge of the forks under the pull tab. The ram/clamping mechanism is moved to a forward position, where the clamp grasps the pull tab. The mechanism is then retracted, drawing the load onto the forks. At the point of delivery, the procedure is repeated in reverse order.

A frequent problem with the use of a push/pull lift truck is that of insertion of the slip sheet under the load being handled. The load, or at least one edge of it, must in some way be elevated above the holding surface so that the slip sheet can be inserted. The present invention is directed to this end. One method used in the past has been to drive the tips of the forks under one edge of the load and lift it sufficiently so that the slip sheet can be put in place. This is both awkward and hazardous. Injuries have occurred when a load slipped off the forks and struck the operator.

One industry in which push/pull lift trucks are widely used is the manufacture of corrugated shipping containers. Few plants are sufficiently conveyorized so that unit load handling is not required. The first place where such handling is needed is at the end of the corrugator. Shipping container blanks are assembled into large units and then delivered either to inventory or directly to printing and box-manufacturing machinery. The problem is particularly acute in plants where the unit packages of box blanks are assembled off the corrugators on down-stackers. This is an apparatus in which the blanks shoot off the end of the corrugating machine onto the top of a pile which is being continually lowered as the unit package is assembled. In most plants having down-stackers, it is difficult, if not impossible, to insert the slip sheet under the bottom of the unit package before it is assembled. After the unit is assembled, it normally moves down a roll case type conveyor from which it is then moved to inventory by a push/pull lift truck.

The prior art does not appear to have addressed the problem of safe and convenient placement of slip sheets under loads to be handled by push/pull lift trucks. While a large number of elevator-type devices are available on the market, none of them appear satisfactory to handle the immediate problem. As an example, the patent to Cestone et al., U.S. Pat. No. 3,680,837, shows a beam supported by a jack at each end with the load suspended beneath the beam. Conceivably, a device of this type could be modified to lift one edge of a package for insertion of a slip sheet. This would have to be placed beneath the beam when the package was elevated. Unfortunately, when the jacks and beam are lowered, the beam still remains located over the slip sheet, unless the jacks have a very long throw so that the pull tab can be freed by bending it down as the jacks descend. This is not a very satisfactory alternative, since very often space is quite limited, so that long travel of the jacks is not possible. Additionally, the tab is often permanently deformed so that it is difficult to grasp by the clamping mechanism on the push/pull truck.

Another elevator mechanism is shown in U.S. Pat. No. 3,752,331 to Colburn. Here a complex scissors and screw mechanism is used to lift a platform which presumably could be placed under one edge of a load. In this instance, the problem of getting the mechanism out of the way of the lift truck is even more complex than in the previous example.

SUMMARY OF THE INVENTION

The present invention is an apparatus for lifting a unit package of material so that a pull sheet can be easily and safely inserted thereunder. It comprises a tiltable elevator means which can be placed under one side of the unit package to lift it for insertion of the pull sheet. The elevator can then be tilted and rolled out of the way without damaging the pull sheet so that a lift truck can have ready access to the unit package. The elevator comprises a cross bar for engaging and supporting the unit. This is tied to spaced-apart jack means which serve to raise and lower the cross bar into and out of lifting engagement with the unit package. When the elevator raises the unit, the slip sheet is readily placed beneath it by passing it beneath the supporting cross bar and between the jacks. The unit is then dropped and the elevator means is tilted or rocked forward by a suitable mechanism so that the cross bar is dropped below the pull sheet and the unit package is accessible for handling.

It is an object of the present invention to provide an apparatus enabling simple and safe insertion of a pull sheet under a load.

It is another object to provide apparatus which can be located beside a conveyor line to enable rapid insertion of a pull sheet under a load.

It is a further object to provide an apparatus which does not severely deform the tab of a pull sheet and which can rapidly be moved out of the way of an approaching push/pull lift truck.

These and other objects will become readily apparent to one skilled in the art upon reading the following detailed description taken in conjunction with the drawings.

DESCRIPTION OF THE PREFERRED EMBODIMENTS

Figure 1:
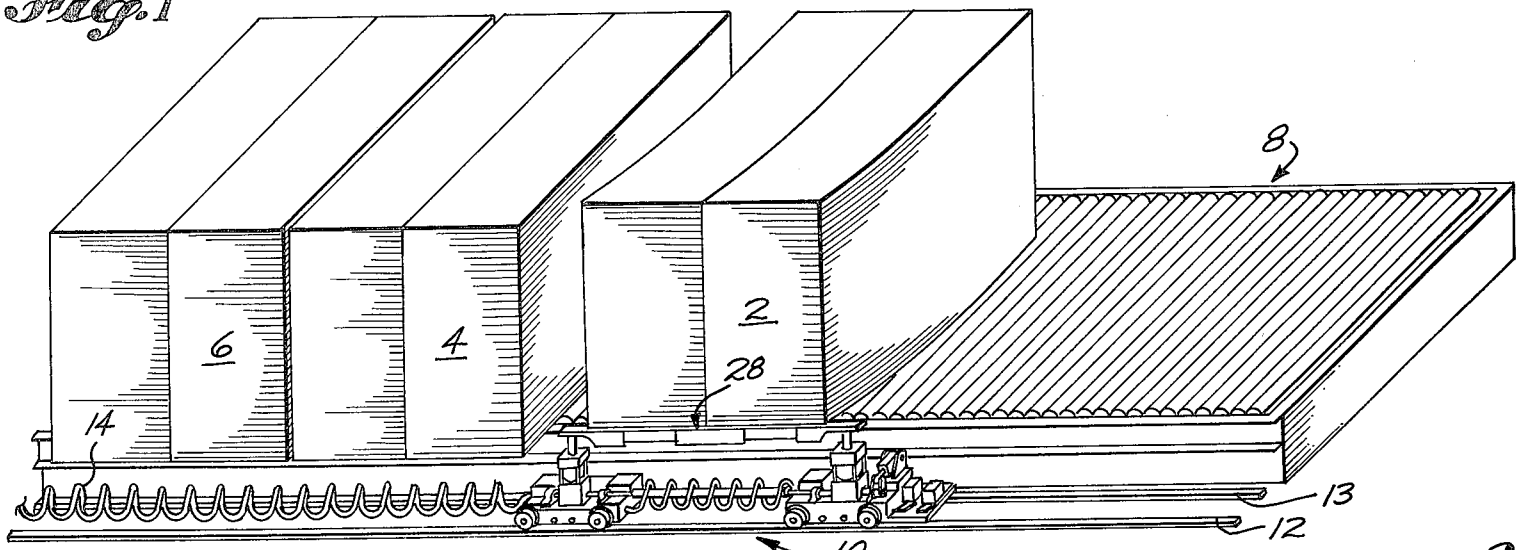
FIG. 1 is a perspective view showing the lifting apparatus in position under a unit package of material on a conveyor line.

The following description of the present invention will relate to the handling of unit packages of corrugated board in a shipping container plant. It will be understood by those skilled in the art that this application is merely exemplary. The apparatus can be used equally well for handling boxes, crates, or any other form of unit load. Referring to FIG. 1, the packages or stacks of shipping container blanks 2, 4, 6 are seen moving down a roll case conveyor line generally designated 8. The package lifting mechanism, generally shown as 10, has been moved into position under one end of unit package 2. In the embodiments shown, the lifting mechanism rides on rails 12, 13 for easy positioning. In many cases, it will be equally practical to mount the apparatus in a fixed position using some other means to center the load over the lifting mechanism. A coiled hose 14 supplies compressed air or hydraulic fluid to operate the cylinders.

Figure 2:
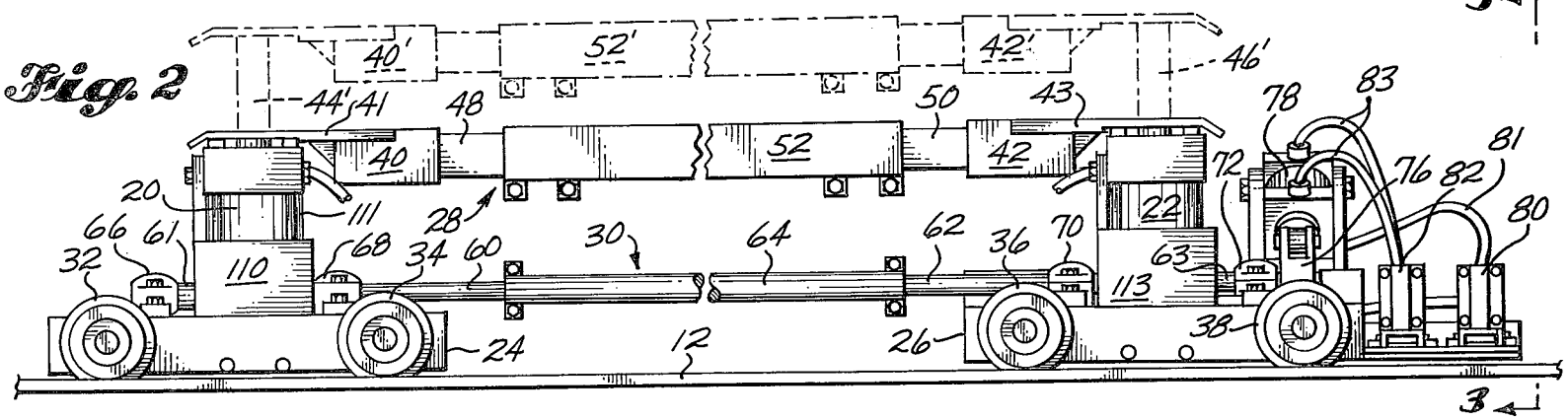
FIG. 2 is a front elevation of the apparatus showing the lifting mechanism in normal and raised position.
Figure 3:
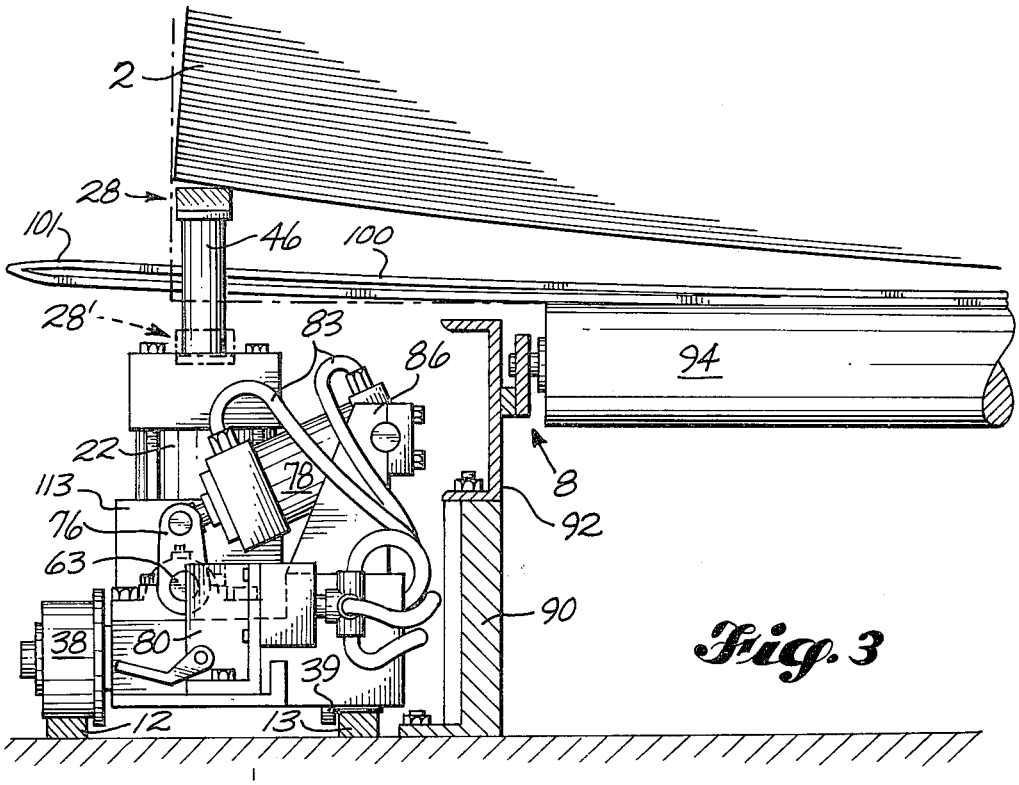
FIG. 3 is a right-end elevation taken along line 3—3 of FIG. 2 and showing details of the location of a slip or pull sheet under the unit package.
Figure 4:
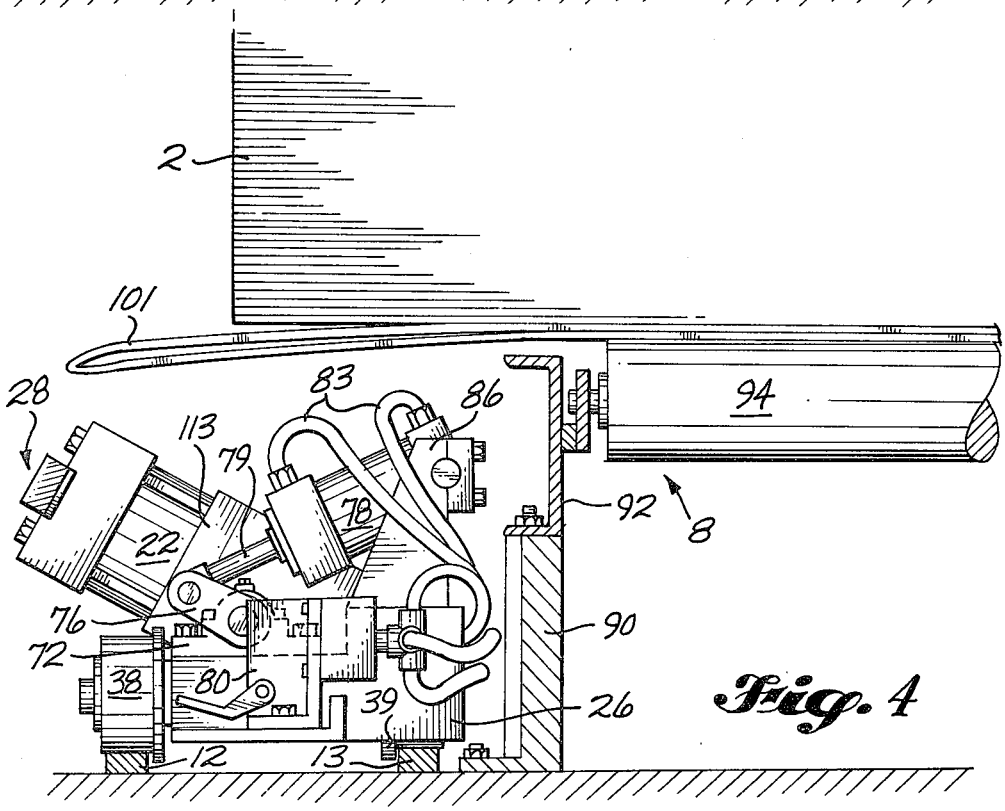
FIG. 4 is a similar view to FIG. 3 in which the elevator means has been tilted forward to allow access by a lift truck or lateral movement of the unit package.
Figure 5:
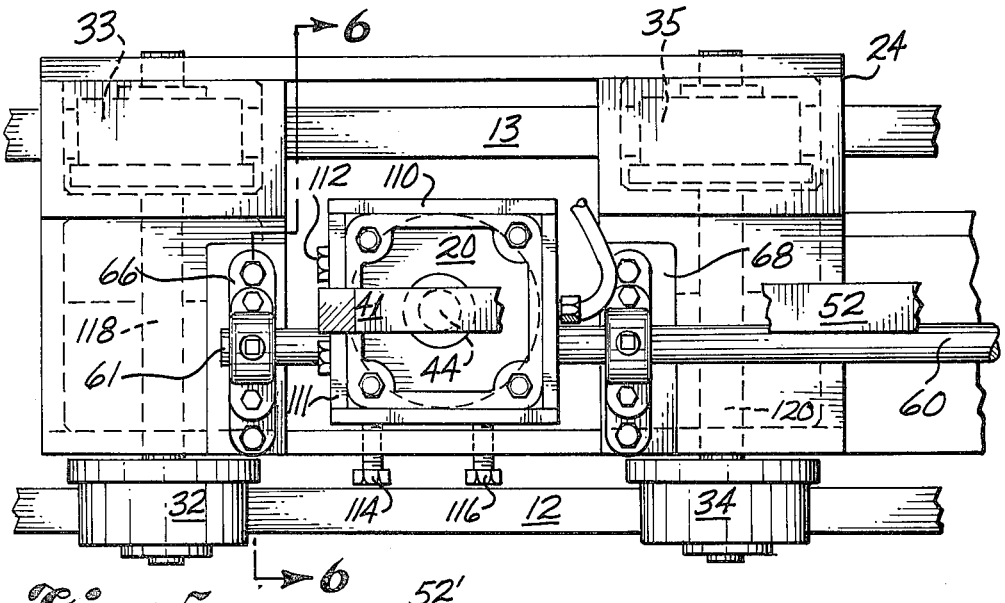
FIG. 5 is a top elevation showing details of the mounting of the left-hand jack unit.
Figure 6:
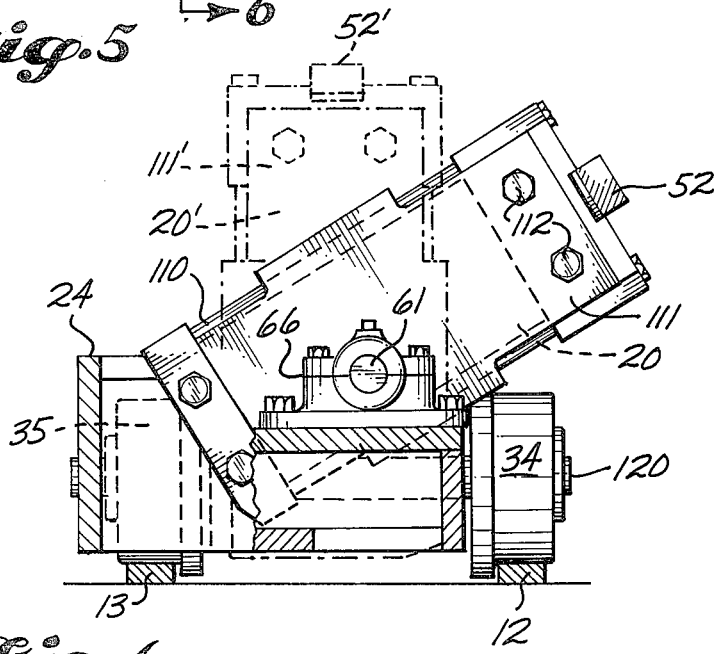
FIG. 6 is a left side elevation taken along line 6—6 of FIG. 5.

Referring now to FIG. 2, the elevator comprises a pair of spaced-apart fluid-actuated cylinders 20, 22 which are bridged by a load-supporting cross bar generally indicated at 28. The left-hand cylinder 20 is cradled on a dolly or frame member 24. Right-hand cylinder 22 is equivalently cradled on a base or frame member 26. The cylinders are rigidly connected by a shaft 30 which serves the function of tilting them forward to remove cross bar 28 from the path of an incoming push/pull lift truck and to permit lateral movement at the elevator. Left-hand dolly 24 is supported on front wheels 32, 34, and rear wheels 33, 35 (FIGS. 5 and 6). Right-hand dolly or base member 26 is supported on front wheels 36, 38. There are equivalent rear wheels, only one of which is shown at 39 (FIGS. 3 and 4). The cross-bar has a left end piece 40, terminating in a lug or ear 41 which is bolted to the piston rod 44 of jack 20. The right-hand portion of cross bar 28 is terminated by an end piece 42 with lug or ear 43 which, in turn, is bolted to the top of piston rod 46 of cylinder 22. A pair of stub shafts 48, 50 are connected to the end pieces and united with a telescoping coupling unit 52. Where width adjustability is not required, the load-supporting cross bar 28 can be made as a unitary construction, as could the basal frames 24 and 26.

Fluid-actuated cylinders 20 and 22 are mounted respectively in box frames 110, 113. Frame 110 bears stub shafts 60, 61 which are journaled in pillow blocks 66, 68. Box frame 113 has welded-on stub shafts 62, 63 which are respectively journaled in pillow blocks 70, 72. Stub shafts 60 and 62 are unitized by a telescoping coupling unit 64. Again, if it was not desired to make the unit adjustable for width, the tilt shaft 30 could be a unitary piece. The far right-hand end of shaft 63 terminates in a crank arm 76. The distal end of the crank arm is pivotally mounted to the piston rod 79 of fluid-actuated cylinder 78.

A foot-operated valve 80 serves to actuate the pistons of the elevator unit through a fluid control line 81. The elevator is shown in a normal lowered position in solid lines in FIG. 2 and in its raised position by the ghost image.

Foot-operated valve 82 serves to actuate cylinder 78 and the tilting mechanism through fluid control lines 83.

FIGS. 5 and 6 show additional detail of the mounting of the jack cylinders in their dollies or base frames. The cylinder 20 is bolted in a steel frame 110 having an elongated side 111 by means of four bolts 112. While in its normal vertical position, the attitude is adjusted by stop bolts 114, 116. The dolly wheels are seen mounted on axles 118, 120. The stub shafts 60 and 61 are welded to frame 110, somewhat forward of the center line. With this arrangement, the piston rods 44, 46 of the jack cylinders will be behind the axis of tilt shaft 30. Under load, this will tend to rotate the jack assembly about the tilt shaft so that it bears firmly against stop screws 114, 116 and their counterparts at the other end of the apparatus. This arrangement will prevent any accidental tilting of the elevator assembly.

Figure 7:
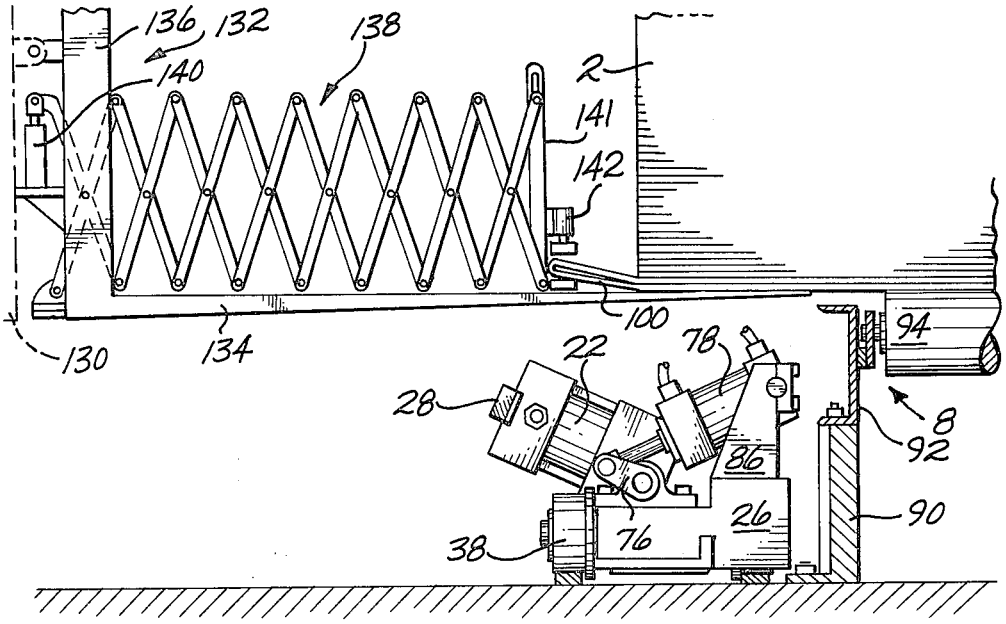
FIG. 7 is a view showing a push/pull lift truck about to take on a unit package.
Figure 8:
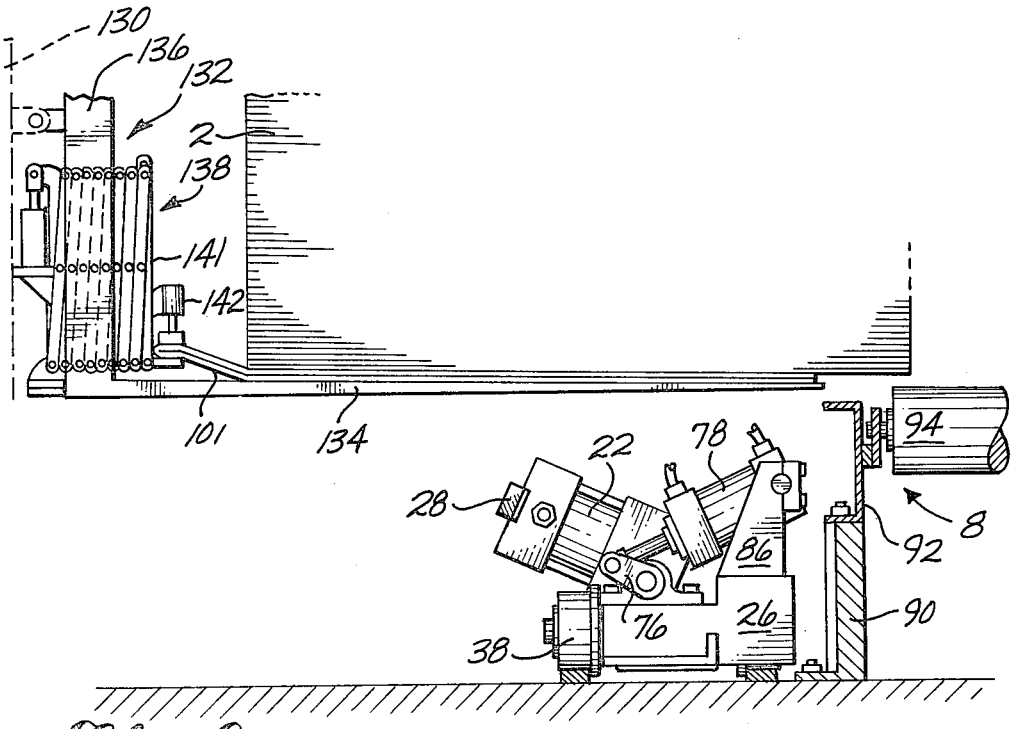
FIG. 8 is a view showing the same package now drawn onto the fork mechanism of the lift truck.

FIG. 1 shows the elevator assembly in a raised position holding up one end of unit package 2 in readiness to receive a slip sheet. FIGS. 3 and 4 show this operation in greater detail. With load 2 raised, the slip sheet 100 is inserted beneath load-supporting cross bar 28 and between the piston rods 44, 46 of the jacks. After the slip sheet has been inserted, the elevator is dropped to its lower position. This will tend to somewhat bend down the tab end 101 of the pull sheets, but it does not yet free the unit for access by the push/pull lift truck. To accomplish this end, tilt cylinder 78 is activated by foot-operated valve 82. This causes the piston rod 79 to extend against crank arm 76 and rotate the elevator unit forward approximately 60°. This tilting or rolling motion drops the load-supporting bar 28 below the pull sheet and frees the unit package for access by the lift truck or for lateral movement across the conveyor. This operation is shown in FIGS. 7 and 8. The truck itself is represented diagrammatically in ghost form at 130. It carries the lifting fork and push/pull attachment generally shown as 132. This consists of the broad finger portion 134 and a back portion 136. A scissors attachment 138 is operated by a fluid-actuated cylinder 140 to move the ram portion 141 and clamp portion 142 forward so that they are approximately at the distal end of the forks. Clamp portion 142 is then activated by the operator to seize the pull-tab as is shown in FIG. 8. The load is then drawn onto the forks by the retraction of scissors unit 138. After the lift truck has reached its destination, the load is discharged by a forward movement of the scissors mechanism which forces ram 141 against the load in order to shove it off the forks into its desired resting position.

In one installation of the present invention, the jack cylinders had a piston diameter of approximately 10 cm and a stroke of 15 cm. The tilt cylinder had a piston diameter of 6.4 cm. These were operated at an air pressure of approximately 620 kPa. This unit was able to handle a load which in maximum dimensions would be approximately 1.5 m high by 1.8 m wide by 2.0 m in length, and with an approximate weight of 1230 kg. The unit was sufficiently compact to be placed beside a conveyor line having only 30 cm clearance between the floor and the bottom of the unit packages.

Having thus described the best mode known to the inventors of carrying out the present invention, it will be evident to those skilled in the art that many variations can be made without departing from the spirit of the invention. The inventors consider the scope to be limited only by the following claims.

What is claimed is:

1. In an apparatus for lifting an overhanging unit package of material resting on a conveyor line in order to enable insertion of a pull sheet under the package so that the pull sheet can then be grasped by a push/pull lift truck to remove the package from the conveyor line, the improvement which comprises:

a. a tiltable elevator means adapted to lie adjacent to and parallel to the conveyor line for placement under the overhanging edge of the unit package, said elevator means further comprising
   (1) a longitudinal cross bar adapted to be disposed parallel to the conveyor line in a position where it can engage and support the package,
   (2) longitudinally spaced apart jack means for raising and lowering the cross bar into and out of lifting engagement with the unit package, and
   (3) a rigid member essentially parallel to the cross bar connecting the jacks, said member being tiltably mounted on a supporting base member,
   said elevator means when raised allowing placement of a pull sheet beneath the unit package by passing it between the jacks and under the cross bar; and (b) means for tilting the elevator means so that after insertion of the pull sheet the cross bar can be arcuately moved away from the conveyor line from a position above to a position below the pull sheet, allowing the pull sheet to become accessible to the lift truck so that the package can be translated laterally off of the conveyor line onto the lift truck.

2. The apparatus of claim 1 in which the supporting base member is wheel-mounted, said wheels being adapted for running on tracks.

3. The apparatus of claim 1 in which the jack means are fluid-operated cylinders.

4. The apparatus of claim 1 in which the tiltable rigid member terminates in a shaft at each end, said shafts being journaled in bearings fixed to the supporting base, at least one of said shafts bearing a crank arm, with means operating between the distal end of the crank arm and the supporting base to tilt the elevator means.

5. The apparatus of claim 4 where the tilting means is a fluid-operated cylinder.

6. The apparatus of claim 1 wherein the spacing between the jack means is adjustable so as to handle unit packages of different widths.

7. The apparatus of claim 6 in which the cross bar and rigid connecting member are of telescoping construction to permit rapid width adjustment.

8. A method for inserting a pull sheet under an overhanging unit package of material resting on a conveyor line which comprises;

a. locating an overhanging portion of the package over a tiltable elevator means, the elevator having a package supporting cross bar disposed parallel to the conveyor line, the cross bar being mounted adjacent to each end on spaced apart jack means;
b. raising the elevator means to lift the overhanging portion of the package sufficiently so that a pull sheet can be inserted under the cross bar and between the jacks and placed between the package and the conveyor line;
c. placing the pull sheet;
d. lowering the elevator and package so that the package rests on the pull sheet, and
e. tilting the elevator means away from the conveyor line so that the cross bar is moved arcuately over the tab end of the pull sheet to a point sufficiently below the pull sheet to allow access so that a push-/pull lift truck can grasp the pull sheet tab and translate the package laterally off of the conveyor line onto the lift truck.

9. The method of claim 8 which further comprises providing a track parallel to the conveyor line and wheel-mounting the elevator means to run on the track so that the elevator can be readily moved into lifting position with respect to the package.

10. The method of claim 8 which further comprises adjusting the length of the cross bar to correspond to the width of the package.

* * * * *